US005996690A

United States Patent [19]

Shaw et al.

[11] Patent Number: 5,996,690

[45] Date of Patent: Dec. 7, 1999

[54] APPARATUS FOR CONTROLLING AND MONITORING A DOWNHOLE OIL/WATER SEPARATOR

[75] Inventors: Christopher K. Shaw, Claremore, Okla.; Michael H. Johnson, Flower Mound, Tex.; Wallace W. F. Leung, Sherborn, Mass.

[73] Assignee: Baker Hughes Incorporated, Houston, Tex.

[21] Appl. No.: 08/938,775

[22] Filed: Sep. 26, 1997

Related U.S. Application Data

[63] Continuation-in-part of application No. 08/469,968, Jun. 6, 1995, Pat. No. 5,762,149.

[60] Provisional application No. 60/038,076, Feb. 25, 1997.

[51] Int. Cl.[6] ..... E21B 43/40

[52] U.S. Cl. ..... 166/250.01; 166/250.15; 166/265

[58] Field of Search ..... 166/250.15, 265, 166/250.01, 53; 210/739, 741, 747, 96.1, 110, 143, 149

[56] References Cited

U.S. PATENT DOCUMENTS

| | | | |
|---|---|---|---|
| 4,738,779 | 4/1988 | Carroll et al. . | |
| 4,770,243 | 9/1988 | Fouillout et al. | 166/265 |
| 4,793,408 | 12/1988 | Miffre . | |
| 4,805,697 | 2/1989 | Fouillout et al. . | |
| 5,296,153 | 3/1994 | Peachey . | |
| 5,456,837 | 10/1995 | Peachey . | |

FOREIGN PATENT DOCUMENTS

| | | |
|---|---|---|
| 2194572 | 3/1988 | United Kingdom . |
| 2194574 | 3/1988 | United Kingdom . |
| 2194575 | 3/1988 | United Kingdom . |

OTHER PUBLICATIONS

Joint Industry Development of the Downhole Oil Water Separation System, Pete Schrenkel et al, date unknown.

Downhole Oil/Water Separator Development, B. R. Peachey et al, The Journal of Canadian Petroleum Technology, vol. 33, No. 7, Sep., 1994.

Application of Downhole Oil/Water Separation Systems in the Alliance Field, Society of Petroleum Engineers, Inc., SPE 35817, 1996.

Downhole Oil/Water Separator Development Project, Centre for Engineering Research Inc., Jul., 1995.

*Primary Examiner*—William Neuder

*Attorney, Agent, or Firm*—Cantor Colburn LLP

[57] ABSTRACT

A computerized (e.g. intelligent) downhole oil/water separation system. A hydrocyclone separator is used downhole to separate oil from water. Downhole sensors monitor parameters associated with the oil/water separation and provide signals representing the parameters to a controller. The controller controls operation of the system by generating control signals and providing the control signals to one or more control devices. The oil/water separation is optimized and well profitability is enhanced.

22 Claims, 3 Drawing Sheets

APPARATUS FOR CONTROLLING AND MONITORING A DOWNHOLE OIL/WATER SEPARATOR

CROSS-REFERENCES TO RELATED APPLICATIONS

This application is a continuation-in-part of U.S. patent application Ser. No. 08/469,968 filed Jun. 6, 1995, now U.S. Pat. No. 5,762,149, and claims the benefit of U.S. Provisional Patent Application Ser. No. 60/038,076 filed Feb. 25, 1997.

BACKGROUND OF THE INVENTION

1. Field of the Invention

The invention relates generally to systems for separating water from hydrocarbons (e.g. oil) in a well and in particular to methods and apparatus for monitoring and controlling a downhole oil/water separator.

2. Prior Art

In an oil well, a quantity of water left from "well completion" or from "water flooding" is mixed with the oil during production and both fluids flow to the surface from underground formations. The water is typically separated at the surface and then injected back into the underground formations. As the water-oil ratio (WOR) increases, the cost of operating the well increases. Much of the cost is in managing the ever increasing volumes of water that must be lifted to the surface, separated, treated, pipelined and injected back into the formations. As the WOR increases, the profitability of the well is diminished until it is no longer economically possible to continue production. This often results in leaving large amounts of oil in place in the formation.

The excessive cost of separating water from oil at the surface of a well has lead to downhole separation systems. U.S. Pat. No. 5,269,153 discloses a downhole separation system which is shown in FIG. 1. The well 13 comprises a downhole oil/water separation system including a cyclone separator 11 having a separation chamber 15 wherein liquids of different densities are separated. Mixed liquids enter through inlet 17 at a high tangential speed so as to generate the required centrifugal force for subsequent separation and pass into separation chamber 15. A first outlet 19 is provided for liquids having a first density and a second outlet 21 is provided for liquids having a second density. A stream of mainly oil flows out of outlet 19 and along recovery conduit 27. A steam of mainly water passes through outlet 21 into disposal conduit 33 and is injected into the formation through injection perforations 34.

While downhole separation systems have improved well performance, there is a need in the art for improved downhole oil/water separation systems. In particular, there is a need for downhole oil/water separation systems that can monitor parameters downhole and control the downhole oil/water separator based on monitored parameters so as to achieve the proper separation and to optimize the performance of the separator. This is well appreciated when the feed entering the separator varies in properties such as oil and water viscosity which depends strongly on temperature and more importantly the water-oil ratio.

SUMMARY OF THE INVENTION

The above-discussed and other drawbacks and deficiencies of the prior art are overcome or alleviated by the apparatus for monitoring and controlling a downhole oil/water separator of the present invention. The present invention is a computer controlled downhole oil/water separation system. A hydrocyclone separator is positioned downhole for receiving production fluid and separating oil and water contained in the production fluid. Sensors are positioned downhole for monitoring parameters and generating sensing signals corresponding to the parameters. A microprocessor based controller receives the sensing signals and provides controlling signals to one or more control devices to optimize the operation of the downhole oil/water separation system.

The computer controlled downhole oil/water separation system reduces the amount of water pumped to the surface of the well. The system can also detect upset conditions when the water percentage becomes too high and cease production from a zone before excessive water is pumped to the surface. By reducing the amount of water pumped to the surfaces the expense of processing and injecting water back into the formation is reduced and well profitability is enhanced.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
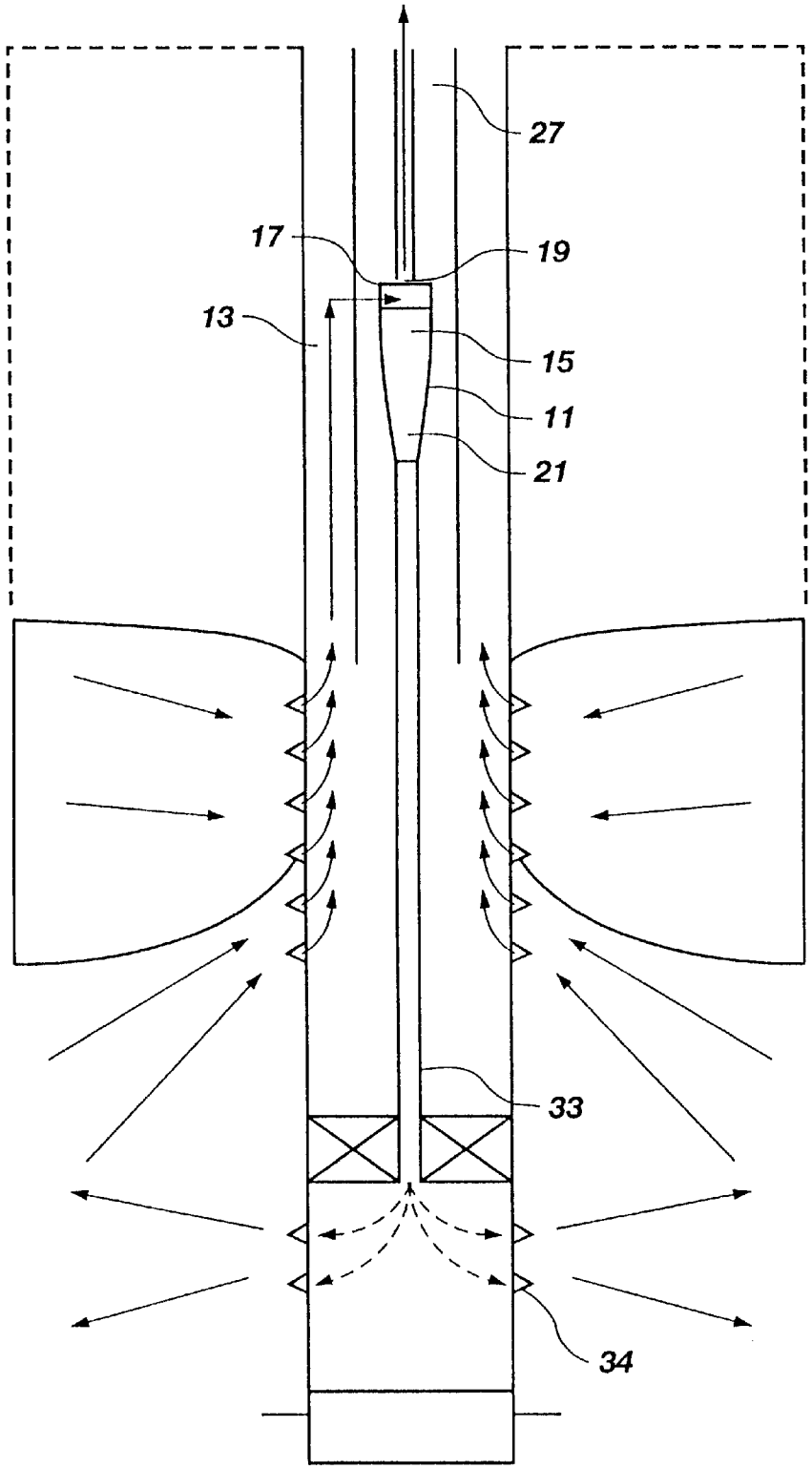
Fig. 1 (PRIOR ART)
FIG. 1 is a diagram of a conventional downhole hydrocyclone separator.
Figure 2:
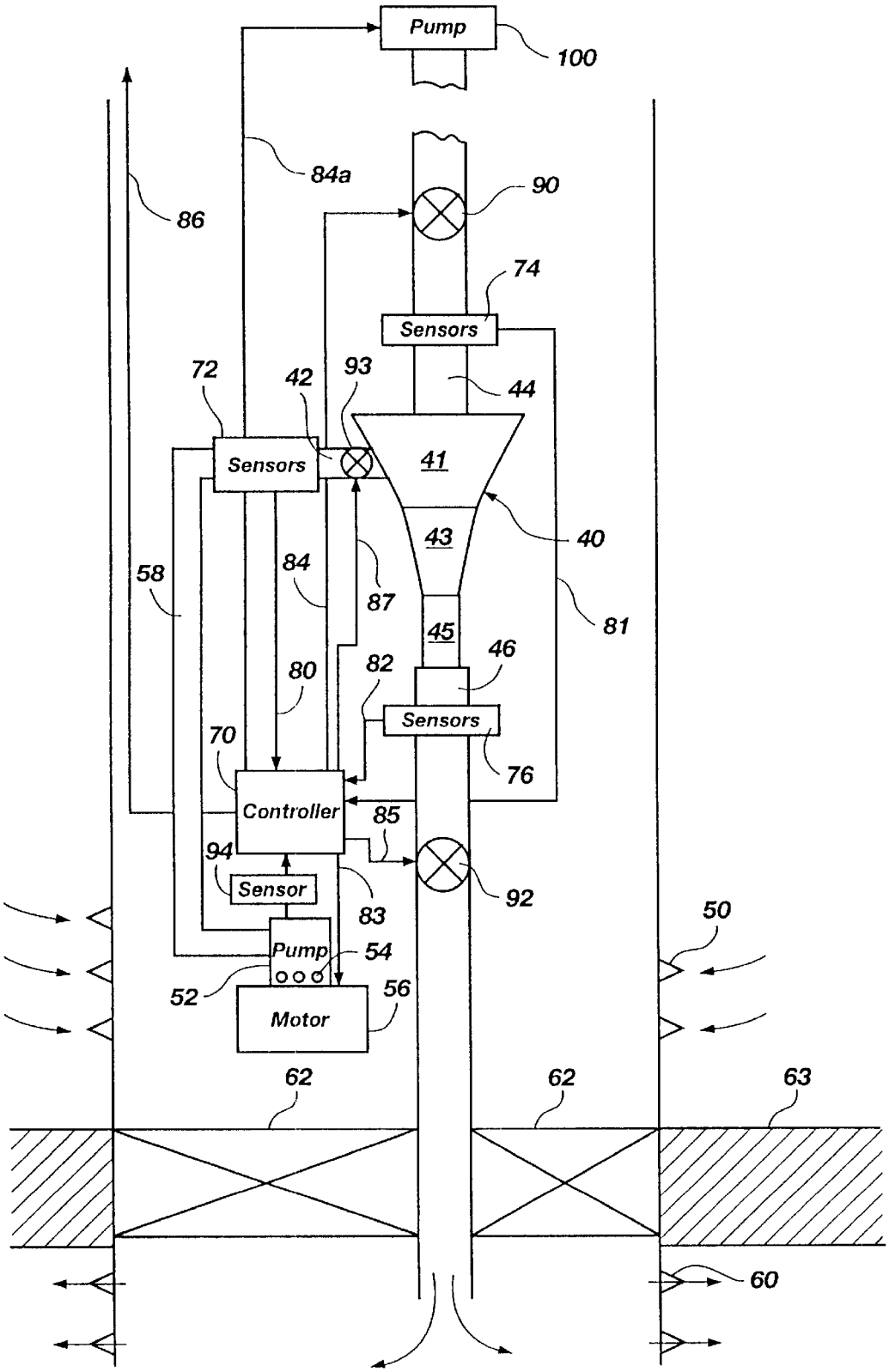
FIG. 2 is a diagram of a downhole hydrocyclone separator system of the present invention.

FIG. 2 is a diagram of the oil/water separation system in accordance with the present invention. The system includes a hydrocyclone separator 40. The hydrocyclone separator has an inlet 42 for receiving production fluid containing a first liquid having a first density (e.g. oil) and a second liquid having a second density (e.g. water). The input production fluid is fed at a high tangential speed so as to generate the required centrifugal force for subsequent separation. The hydrocyclone separator is made up of a first section 41, a second section 43 and a third section 45. The second section 43 has an apex angle of approximately 5–7 degrees. The third section 45 is a shallow, conical tube having an apex angle of 3–5 degrees and increases the time for separation.

A first outlet conduit 44 is provided for the first liquid and a second outlet conduit 46 is provided for the second liquid. The hydrocyclone separator 40 is similar to conventional liquid/liquid hydrocyclone separators in which the heavier liquid (e.g. water) is forced to the wall of the separator under centrifugal force and directed to the second outlet 46. The lighter liquid (e.g. oil) is displaced towards the center by buoyancy forces and flows through first outlet conduit 44. A pump 100 is located uphole in first outlet conduit 44 to pump the oil to the surface if required.

The production fluid is drawn through production perforations 50 formed in the well casing. A pump 52 has pump inlets 54 through which production fluid is drawn and pumped along conduit 58 to the hydrocyclone inlet 42. A motor 56 drives pump 52. The motor 56 may be any known type of motor including electric, hydraulic or pneumatic. As will be described below, the motor 56 is configured to respond to a controlling signal to change its RPM and thus the pump rate of pump 52. Water is passed through second outlet conduit 46 and injected back into the formation at a different stratum isolated from the producing hydrocarbon formation by barrier 63 through injection perforations 60. A packer 62 isolates the production perforations 50 from the injection perforations 60.

The downhole oil/water separation system includes a controller 70 which monitors parameters of the downhole oil/water separation system and controls operation of the system. The controller 70 includes a microprocessor and other associated components such as memory, I/O ports, etc. that are known in the art and which can tolerate the harsh environment downhole (high temperature, corrosion, pressure, etc.). Sensors are employed throughout the downhole oil/water separation system for monitoring parameters of the system and forwarding sensing signals representative of these parameters to the controller 70. The controller 70 may be located downhole as shown in FIG. 2 or may be placed at the surface in which signals are transmitted across the formation through wires or cables or wireless transmission, such as telemetry. An inlet sensor 72 is positioned at the inlet of the hydrocyclone separator 40, a first outlet sensor 74 is positioned in the first outlet conduit 44 and a second outlet sensor 76 is positioned in the second outlet conduit 46. In the embodiment shown in FIG. 2, the sensors are connected to the controller 70 through wires 80, 81 and 82, respectively. It is understood that other communication techniques may be employed. For example, the sensors may also communicate with the controller 70 through telemetry thereby excluding the need for wires 80, 81 and 82. Sensor 94 is coupled to pump 52 and controller 70 through wires or telemetry and monitors the intake pressure at pump 52.

The controller 70 produces controlling signals and provides the controlling signals to one or more control devices. The control devices include the motor 56, a first control valve 90 positioned in the first outlet conduit 44, a second control valve 92 positioned in the second outlet conduit 46, an inlet control valve 93 positioned in the inlet of the separator 40 and pump 100. The first control valve 90 may be eliminated and flow through first conduit 44 may be controlled directly by controlling pump 100 through wire 84*a*. Alternatively, pump 100 and first control valve 90 may be used in conjunction. In the embodiment shown in FIG. 2, the controller 70 is connected to the control devices through wires 83, 84, 85, 87 and 84*a*, respectively. It is understood that other communication techniques may be employed. For example, the controller 70 may also communicate with the control devices through telemetry thereby eliminating the need for the wires. The controller 70 may also communicate with the surface of the well over wire 86 or through telemetry. As mentioned previously, the motor 56 may have a variety of configurations (electric, hydraulic, pneumatic, etc.) and is adapted to adjust the motor in response to a controlling signal from controller 70. The motor 56 affects the volumetric flow rate and pressure along conduit 58 and the downhole separator inlet 42. The volumetric feed rate in turn affects the tangential speed and consequently the centrifugal gravity developed for separation. An adjustable inlet valve 93 is installed at the inlet of the hydrocyclone separator. By the adjusting the cross sectional flow area, the feed velocity and therefore the centrifugal force can be maintained constant or higher independent of the volumetric flow rate. The valve opening 93 can be controlled by wire 87 from the controller 70. Likewise, the first control valve 90 and the second control valve 92 may have a variety of configurations, but must be able to incrementally open and close in response to controlling signals from the controller 70.

The inlet sensors 72 detect the flow rate, pressure, temperature and water percentage of the production fluid entering the inlet conduit 42. Based on these parameters, the controller 70 generates controlling signals and provides the controlling signals to the appropriate control device or control devices. For example, if the hydrocyclone separator is designed to optimally operate at a predetermined flow rate of inlet production fluid, the controller 70 can adjust the revolutions-per-minute (RPM) of motor 56 to establish the ideal inlet flow rate, and in combination in with the valve setting 93 which adjusts the flow area, the optimal centrifugal force can be established. Similarly the inlet pressure, inlet temperature and inlet water percentage are used to control the system. If the water percentage at the inlet becomes too high, it may be determined that the formation is no longer producing sufficient amounts of oil. In this case, the motor 56 may be increased to effect production of incremental oil.

The first outlet sensors 74 detect the pressure, temperature and water percentage at the first outlet conduit 44. Sensing signals corresponding to these parameters are provided to controller 70 and the controller 70 generates controlling signals and provides the controlling signals to the appropriate control device or control devices. The controller 70 controls the control devices so that the water percentage at first outlet conduit 44 is a minimum. The second outlet sensors 76 monitor pressure, flow rate, water percentage, and solid particle concentration at the second outlet conduit 46. The controller 70 receives sensing signals from sensors 76 and generates the necessary controlling signals. One or more of the control devices are controlled so that the water percentage in second outlet conduit 46 is maximized.

Specific examples of how the control devices are manipulated will now be described. The following control processes are exemplary and are not intended to represent all the control processes that may be executed by the present invention. The control processes may be used alone or in combination with other control processes.

In a first control process, the pump intake pressure is monitored by sensor 94 and a sensing signal is provided to the controller 70. Based on the pump intake pressure, the controller 70 sends controlling signals to the motor 56 to adjust the motor speed so that the pump intake pressure is minimized. By minimizing the pump 52 intake pressure, the well inflow, and thus well production, is maximized.

Another control process is based on the oil concentration in the second output conduit 46 sensed by sensors 76. If the oil concentration at sensor 76 increases, second control valve 92 should be incrementally closed and/or first control valve 90 may be incrementally opened. Alternatively, the speed of pump 100 may be increased. All of these adjustments have the effect of increasing the oil flow rate through first outlet conduit 44. However, in this process the water concentration in the first liquid output conduit 44 sensed by sensors 74 should be maintained at an acceptable low level.

In yet another control process, the oil concentration at the inlet conduit 42 is monitored to establish a minimum volumetric flow rate through first outlet conduit 44. If the oil concentration is high at inlet conduit 42 as monitored by sensors 72, then the first control valve 90 is opened or the speed of pump 100 is increased to facilitate removal of the oil. Alternatively, if the oil concentration at inlet 42 is low, then first control valve 90 is incrementally closed or the speed of pump 100 is reduced to prevent water for exiting through first outlet conduit 44.

In yet another control process, the separator pressure differential ratio is monitored and adjusted dependent upon the oil concentration at inlet 42. The separator pressure differential ratio is defined as:

(inlet pressure at 42–outlet pressure at 44)/(inlet pressure at 42–outlet pressure at 46).

The ratio identifies what percentage of the liquid entering the separator at inlet 42 is distributed to the first outlet conduit 44 and the second outlet conduit 46. For a given oil concentration at the inlet 42, there is an optimal separator pressure differential ratio. Accordingly, the oil concentration at inlet 42 is monitored by sensors 72 and the first control valve 90 and/or pump 100 and the second control valve 92 are adjusted so that the separator pressure differential ratio is optimized for the given inlet oil concentration.

In yet another process, when the water content in the first liquid conduit 44 exceeds an acceptable level the cross section area of valve 93 can be reduced to generate a higher velocity and hence a higher centrifugal force for separation. The controller 70 also signals the pump motor 56 to increase RPM to pump against the back pressure established by the further restriction from the inlet valve 93 given that the volumetric feeding rate is held constant.

Figure 3:
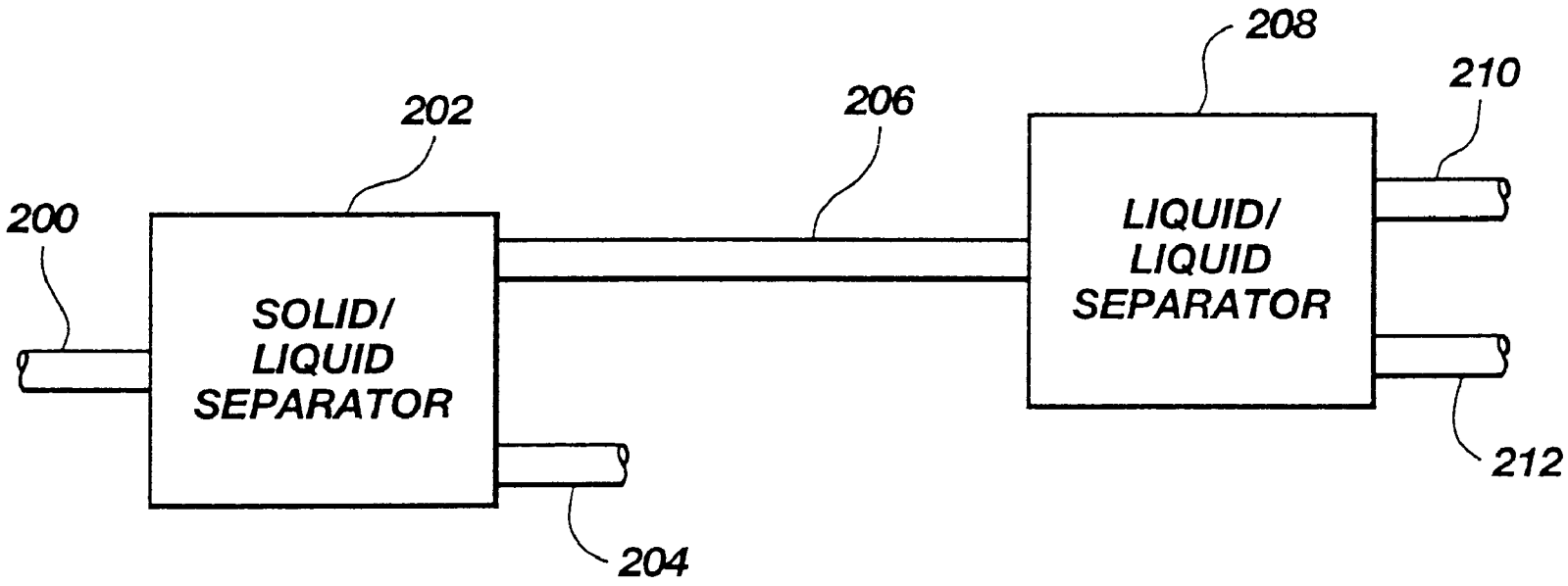
FIG. 3 is a block diagram of staged hydrocyclone separators in accordance with the present invention.

The present invention can also be modified to provide for the removal of solids from the production fluid containing solids, a first liquid (e.g. oil) and a second liquid (e.g. water). A flow through filter (e.g. screen) maybe used to strain the solid material from the first and second liquids. Alternatively, staged hydrocyclone separators may be used as shown in FIG. 3. A feed conduit 200 carries production fluid containing solids, a first liquid and a second liquid. A solid/liquid separator 202 separates the solids from the two liquids. The solids are output through solid outlet conduit 204 and the mixed liquids are output through conduit 206. A liquid/liquid separator 208 operates in accordance with the system described above with reference to FIG. 2 and outputs the first liquid through conduit 210 and the second liquid through conduit 212.

The present invention provides for intelligent control of a downhole oil/water separator by including sensors, control devices and a controller downhole with the separator. The sensors monitor parameters of the separation system and the controller controls portions of the system to maximize oil/water separation. The controller can also determine when the water percentage is so high that production from a particular zone should be discontinued. This prevents excess water from being pumped to the surface and reduces the costs associated with processing and injecting water from the surface back into the formation.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A downhole system for separating a first liquid from a second liquid in a production fluid, the system comprising:

a separator for separating the first liquid from the second liquid;

at least one sensor for monitoring parameters associated with said separator and producing a sensing signal;

a controller for receiving said sensing signal and generating a controlling signal; and a control device responsive to said controlling signal for controlling the separator wherein said separator includes an inlet conduit and said sensor monitors parameters at said inlet conduit.

2. The system of claim 1 further comprising a pump for providing the production fluid to an inlet of said separator, said control device comprising a motor for driving said pump.

3. The system of claim 1 wherein said separator includes a first outlet conduit and said control device comprises a first control valve positioned in said first outlet conduit.

4. The system of claim 1 wherein said separator includes a first outlet conduit and said control device comprises a pump coupled to said first outlet conduit.

5. The system of claim 1 wherein said separator includes a second outlet conduit and said control device comprises a second control valve positioned in said second outlet conduit.

6. The system of claim 1 wherein said sensor positioned at said inlet conduit monitors flow rate.

7. The system of claim 1 wherein said sensor positioned at said inlet conduit monitors pressure.

8. The system of claim 1 wherein said sensor positioned at said inlet conduit monitors temperature.

9. The system of claim 1 wherein said sensor positioned at said inlet conduit monitors water percentage.

10. The system of claim 2 wherein said sensor monitors pump intake pressure.

11. The system of claim 1 wherein said separator is a hydrocyclone separator.

12. The system of claim 1 wherein said separator includes an inlet conduit and said control device comprises an inlet control valve positioned in said inlet conduit.

13. A downhole system for separating a first liquid from a second liquid in a production fluid, the system comprising:

a separator for separating the first liquid from the second liquid;

at least one sensor for monitoring parameters associated with said separator and producing a sensing signal;

a controller for receiving said sensing signal and generating a controlling signal; and a control device responsive to said controlling signal for controlling the separator wherein said separator includes a first outlet conduit and said sensor monitors parameters at said first outlet conduit.

14. The system of claim 13 wherein said sensor positioned at said first outlet monitors pressure.

15. The system of claim 13 wherein said sensor positioned at said first outlet monitors water and oil percentage.

16. The system of claim 13 wherein said sensor positioned at said first outlet monitors temperature.

17. A downhole system for separating a first liquid from a second liquid in a production fluid, the system comprising:

a separator for separating the first liquid from the second liquid;

at least one sensor for monitoring parameters associated with said separator and producing a sensing signal;

a controller for receiving said sensing signal and generating a controlling signal; and a control device responsive to said controlling signal for controlling the separator wherein said separator includes a second outlet conduit and said sensor monitors parameters at said second outlet conduit.

18. The system of claim 17 wherein said sensor positioned at said second outlet monitors pressure.

19. The system of claim 17 wherein said sensor positioned at said second outlet monitors water and oil percentage.

20. The system of claim 17 wherein said sensor positioned at said second outlet monitors flow rate.

21. The system of claim 17 wherein said sensor positioned at said second outlet monitors a concentration of solid particles.

22. A downhole system for separating a first liquid from a second liquid in a production fluid, the system comprising:

a separator for separating the first liquid from the second liquid;

at least one sensor for monitoring parameters associated with said separator and producing a sensing signal;

a controller for receiving said sensing signal and generating a controlling signal; and a control device responsive to said controlling signal for controlling the separator wherein:

said separator has an inlet conduit, a first outlet conduit and a second outlet conduit;

said at least one sensor includes a sensor for monitoring inlet pressure at said inlet conduit, a sensor for monitoring pressure at said first outlet conduit and a sensor for monitoring pressure at said second outlet conduit, said controller determining a separator pressure differential ratio based on the pressure at said inlet conduit, the pressure at said first outlet conduit and the pressure at said second outlet conduit and generating said controlling signal based on the separator pressure differential ratio.

* * * * *